United States Patent [19]

Kato et al.

[11] 4,112,671

[45] Sep. 12, 1978

[54] PULSE MOTOR DRIVING SYSTEM FOR USE IN A TIMEPIECE

[75] Inventors: Yoshiaki Kato, Higashimurayama; Jinro Motoki, Houya, both of Japan

[73] Assignee: Citizen Watch Co., Ltd., Tokyo, Japan

[21] Appl. No.: 753,538

[22] Filed: Dec. 22, 1976

[30] Foreign Application Priority Data

Dec. 26, 1975 [JP] Japan ..... 51-157169

[51] Int. Cl.[2] ..... G04C 5/00; G04C 9/00

[52] U.S. Cl. ..... 58/23 D; 58/85.5

[58] Field of Search ..... 58/23 R, 23 A, 23 BA, 58/23 AC, 23 D, 85.5

[56] References Cited

U.S. PATENT DOCUMENTS 3,939,644 2/1976 Wolf ..... 58/23 R

*Primary Examiner*—Stanley J. Witkowski

*Attorney, Agent, or Firm*—Sherman & Shalloway

[57] ABSTRACT

Pulse motor driving system for use in a timepiece. The driving system has a single phase coil and permanent rotor which are stepped in a forward direction by a forward rotation driving voltage. The voltage is composed of a plurality of pulses having the same polarity. Provision is made for a control circuit connected between a frequency divider and pulse motor driving circuit. The control circuit applies a plurality of driving voltage pulses for rotating the rotor of the pulse motor in the reverse direction. The control circuit also can provide accelerated pulses to the movement of the rotor in the reverse direction thereby stepping the rotor in the reverse direction. This enables the lag of gaining hands thereby correcting the time display in preciseness.

10 Claims, 14 Drawing Figures

A
B
3
2
2a
2b
2c
2d
1
θa
N
S
VDD
VSS
T1
T2
T3
T4
Φ1
Φ2
VAB
θ
π
0
-θa
-π
t

PULSE MOTOR DRIVING SYSTEM FOR USE IN A TIMEPIECE

BACKGROUND OF THE INVENTION

This invention relates to a pulse motor driving system for enabling reverse rotation of a pulse motor for use in driving a display of a timepiece.

Heretofore well-known is a crystal timepiece provided with a super-miniature pulse motor wherein wheel trains carrying the timepiece hands are stepped in proportion to the count of a crystal oscillator. However, it is very inconvenient to adjust the second hand of the timepiece to the standard time. The advance of a lagged timepiece can be effected comparatively easy since the forward rotation of the pulse motor enables a fast-feeding of the hands by shortening the driving intervals. However, instantaneous adjustment cannot be attained when the kept time of the timepiece is gained. This is because the kept time would have to be lost and the prior art only allows stopping of the driving of the pulse motor so that the standard time may gain upon the kept time.

SUMMARY OF THE INVENTION

An object of the invention is to obviate the conventional defects as set forth above and to provide a pulse motor driving system for a timepiece wherein a pulse motor may be reversely rotated by applying a special driving wave form thereto.

A further object of the invention is to provide an electronic timepiece driving system in which the hands are adjusted precisely and easily.

Still a further object of the invention is to simplify time correction means in various kinds of timepieces.

Still another object is to obtain special informations by increasing the kinds of the movement of the hands.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figures 1, 2, 3, 4, 5, 6:
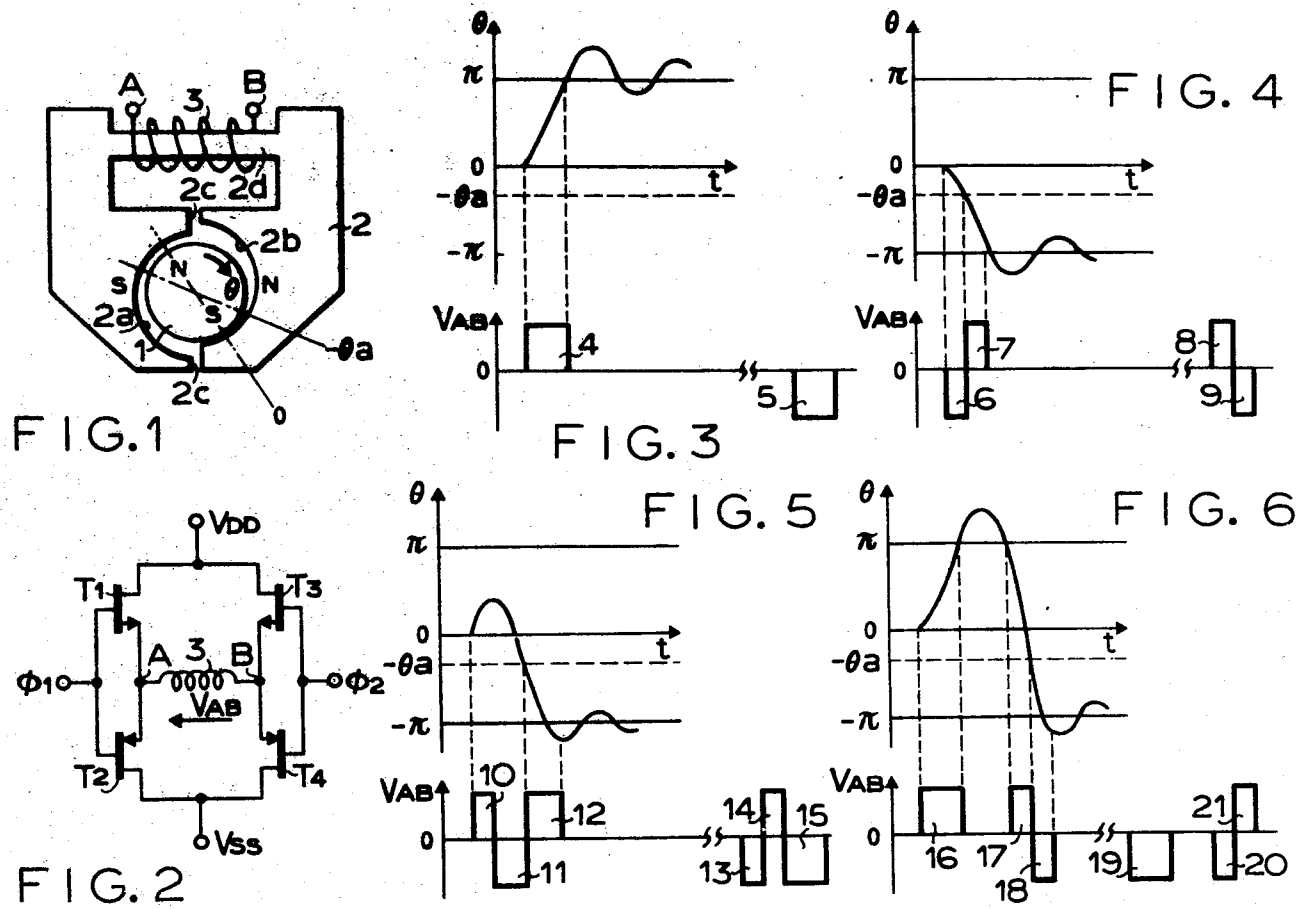
FIG. 1 is a plan view of a pulse motor to which a pulse motor driving system of the invention is adapted.
FIG. 2 is a driving circuit diagram in the driving system according to the invention.
FIG. 3 is a timing chart showing a driving wave form during forward rotation and rotating position of a rotor.
FIGS. 4 through 6 are timing charts showing various kinds of driving wave forms during reverse rotation and rotating positions of the rotor.

In FIG. 1 reference numeral 1 depicts a rotor composed of a disc shaped permanent magnet magnetized in a diameter direction to have two poles. Reference numeral 2 illustrates a stator consisting of a soft magnetic plate which is divided into semicircular portions 2*a*, 2*b* arranged around the rotor by slits 2*c*, 2*c*. A single phase drive coil 3 is wound about a thin portion 2*d* in a magnetic circuit.

The semicircular portions 2*a*, 2*b* are not arranged on a single circle as shown in FIG. 1, that is, they deviate from a circular arrangement so that uneven spaces may be formed at the periphery of the rotor magnet 1 and as the result, the magnetizing direction of the rotor is settled in direction O. This direction O is entitled "static stable position" as the reference of a rotation angle and the direction of the arrow shows "forward rotating direction $\theta$ of the rotor." When a DC voltage negative in sign is applied to coil terminals A, B, the stator 2 is magnetized with the left side portion being S pole and right side portion being N pole. As the result, the magnetic poles on the rotor 1 are attracted by the poles to rotate in a reverse direction and stop in a balanced position $-\theta a$ which is entitled "magnetic stable position." When a DC voltage positive in sign is applied to the coil 3, the stator 2 is magnetized in the reverse direction and as the result, the rotor 1 is repelled to rotate in a positive direction by $\pi-\theta a$ to balance. Then, when the positive voltage is applied, the magnetization force is eliminated and the rotor 1 further advances by $\theta a$ to reach a new static stable position. As the result, the rotor 1 is rotated by 180° ($\pi-\theta a+\theta a$) from the initial state. Since the polarity of the rotor 1 becomes reversed to the initial state with reference to the stator 2, a voltage negative in sign has to be applied to the coil 3 in order to advance the rotor 1 by one step further.

FIG. 2 is one embodiment of a pulse motor driving circuit for use in this invention, which comprises a bridge circuit composed of two pairs of complementary transistors as depicted by references $T_1$, $T_2$ and $T_3$, $T_4$. Input terminals $\phi_1$, $\phi_2$ are kept at the same potential ($V_{DD}$ or $V_{SS}$) when the pulse motor is not driven and thus both terminals A, B across the coil 3 are at the potential $V_{DD}$ or $V_{SS}$, thereby no current flowing therethrough. If the potential of the input terminals is varied so that the potential at one of the coil terminals A, B is changed, between the terminals A and B arises a driving voltage $V_{AB}$ substantially equal to the difference of $V_{DD}$ and $V_{SS}$ so that a driving current flows through the coil 3. A direction of the driving current can be changed by variation of a direction of the voltage $V_{AB}$ in dependence upon applying an input signed to any of the input terminals $\phi_1$, $\phi_2$.

FIGS. 3 through 6 are timing charts showing the variations of driving wave forms $V_{AB}$ and rotation direction $\theta$ of the rotor 1 with regard to time *t*. Let the rotor start from a position where the rotor starts to rotate in the forward direction by a pulse positive in sign. FIG. 3 shows the state that the rotor 1 is rotated in the forward direction.

As described with FIG. 1, the rotor 1 is advanced by one step ($\pi$ radian) when a pulse voltage positive in sign is applied. When the pulses are discontinued, as when the stepping of the rotor 1 is substantially accomplished, the rotor 1 is overshot so as to effect declining oscillation and finally converge at the static stable position O. The next stepping of the rotor 1 is similarly effected by a pulse negative in sign and then the same processes are repeated successively. Pulses 4, 5 may be a group of thin pulses having the same polarity replacing a single pulse.

FIG. 4 shows the state of stepping caused by the reverse rotation. At first, the rotor 1 is attracted and accelerated to the magnetic stable position in the reverse direction by a pulse 6 negative in sign. Next, the inverted pulse 7 is applied so that the rotor 1 passing through the stable position by an inertia movement may be repelled and thereby being accelerated in the reverse direction and advanced by $-\pi$.

When the driving of the pulse motor is finished, the rotor 1 is converged at the static stable position O with oscillating so as to be stepped in the reverse direction. The next reverse stepping is similarly effected by a group of pulses 8, 9 with an inverted polarity respectively.

FIG. 5 shows another embodiment of a voltage wave form for driving the pulse motor in the reverse direction comprising a first pulse 10 positive in sign, of which the width is too thin to complete the forward stepping of the rotor 1, a second pulse 11 which attracts and accelerates the movement returning to the position $-\theta a$ and a third pulse 12 which repels and accelerates its rotation to the position $-\pi$. The successive reverse rotation is caused by a group of pulses 13, 14 and 15.

FIG. 6 shows further another embodiment of a voltage wave form for driving the pulse motor in the reverse direction in which first a pulse 16 makes the pulse motor step in the forward direction and then pulses 17, 18 accelerate the rotation to effect the reverse rotation upon the returning movement of the overshooting. The following reverse rotation is performed by a group of pulses 19, 20 and 21. In practice, voltage wave forms are complicated by an inductance in the coils 3 and counter electro-motive voltage caused by the magnet movement.

Experimental data will be described concerning a handtype crystal wrist watch to which the driving system of this invention is applied.

A pulse motor as shown in FIG. 1 is used under the following conditions.

A rotor is composed of a samaricum cobalt magnet having anisotropy axis (16 megagauss oersted as its energy product) and an external dimension of 1.6 $\phi \times$ 0.5 (mm);

A stator is composed of a permalloy material made of 78% Ni and 0.75 mm in thickness, in which each radius of semicircular portions 2*a*, 2*b* is 1.1 mm, the amount of the relative deviation at the semicircular portions 2*a*, 2*b* in arrangement is 40 $\mu$m, the width of slits 2*c*, 2*c* separating the semicircular portions 2*a*, 2*b*, a portion 2*d* corresponding to a core of a coil is made of the same permalloy material as the other portion and having a size of 1.0 $\times$ 0.8 $\times$ 10.7 (mm) and the coil is composed of a copper wire with 28 $\mu$m$\phi$ in diameter which is wound by 1000 turns and has a DC resistance of 2.1 k$\Omega$. The output from the pulse motor is derived from a rotor wheel pinion to be delivered to normal type indicator trains.

A stepping interval of the pulse motor is one second and the output torque is measured by an hour hand axis decelerated to 1/1800. The driving circuit comprises C/MOS transistors, the voltage of the power supply source is about 1.5 V and the driving voltage is arranged to be applied to the coil. In the above arrangement, use is made of each pulse being a single one shown in FIG. 3 for the forward rotation having a width of 1/128 second and a group of pulses for the reverse rotation composed of the wave forms as shown in FIG. 4 comprising the second pulse which is equal to the first pulse having the width of 1/256 sec. As the result, there is obtained the output torque of 4.5 g.cm and average driving current of 2 $\mu$A during the forward rotation, and the output torque of 1.5 g.cm and average driving current of 1.5–1.7 $\mu$A during the reverse rotation.

The test proves that this invention gives sufficient faculties to a known pulse motor and enables the reverse rotation of a pulse motor whereas it had been believed that a motor can be rotated in the forward direction only.

In order to rotate a pulse motor in the reverse direction in accordance with the invention, use may be made of a pulse motor system such that the wave form in FIG. 3 or FIGS. 4, 5 or 6 is selectively applied to the same driving coil by changing over due to a control circuit.

Figure 7:
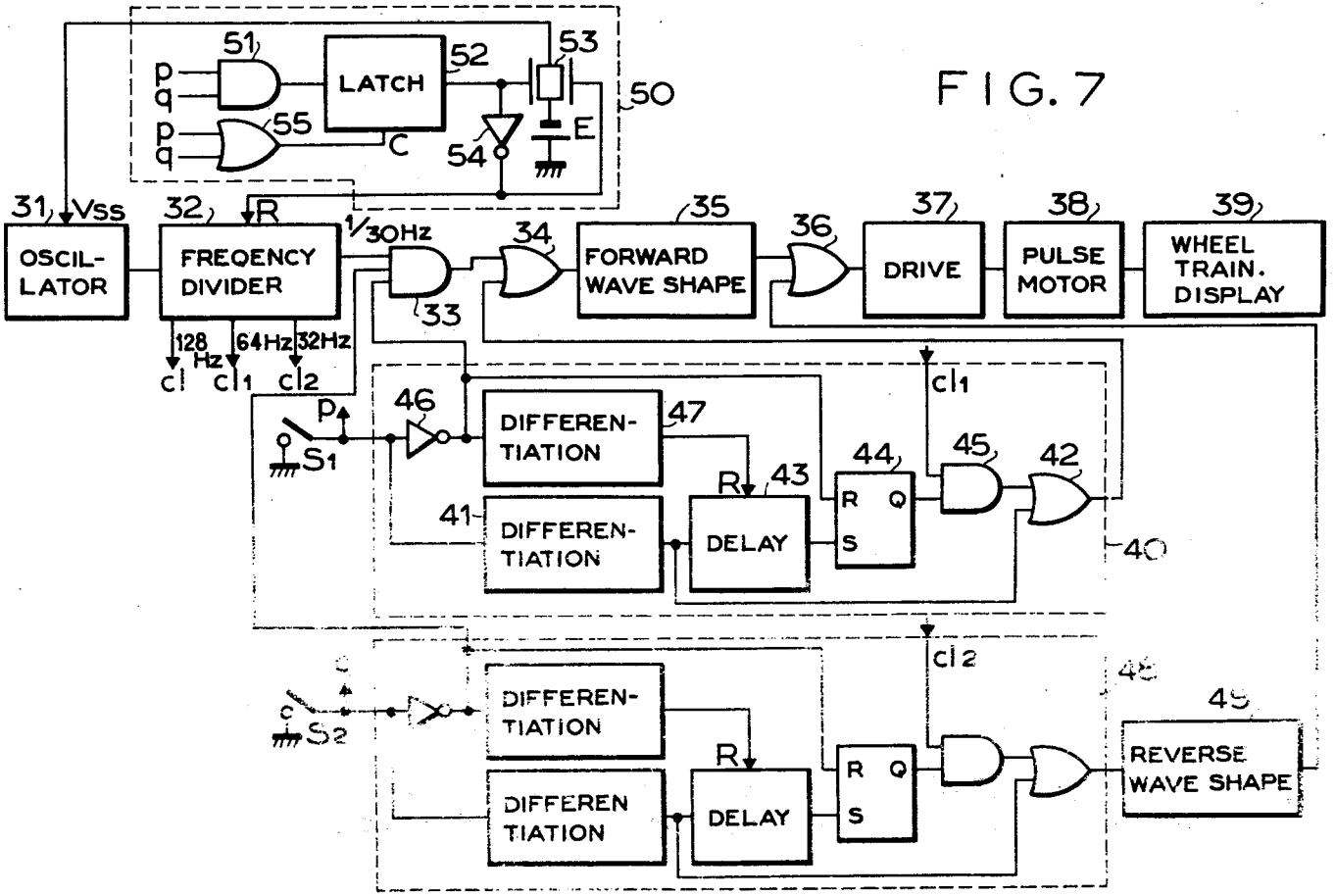
FIG. 7 is a block diagram of a two hand-type crystal timepiece wherein the driving system of the invention is adapted to adjustment of the hands.

There will be shown one embodiment of an electronic timepiece including such a driving system. FIG. 7 is a system diagram showing the control of hand adjustment of a two hand crystal timepiece without the second hand wherein its pulse motor is driven for a long period at an ordinary time. Reference numeral 31 depicts a crystal oscillator of 32768 Hz, 32 frequency dividers connected in series, from each stage of which there are derived a clock pulse $Cl_1$ for fast-feeding the pulse motor in a forward direction and a clock pulse $Cl_2$ for fast-feeding the same in a reverse direction. The period of the final output is 30 seconds with 1/128 second pulse width and ordinarily passes through an AND gate 33, OR gate 34 and forward direction wave shaping circuit 35 to obtain a driving wave form for a forward direction so as to convert its wave form and thereby the converted wave form being applied through OR gate 36 to the driving circuit 37 as shown in FIG. 2. As the result, the pulse motor 38 is stepped in a forward direction every 30 seconds. Then the output of the rotor is transmitted to the wheel train 39 connected to the minute and hour hands. It takes 12 hours, that is, requires 1440 pulses to circulate the whole of the indicator system. Reference numeral 40 illustrates a first control circuit for correction and $S_1$ denotes a switch which is a push button opened at an ordinary time and manually operated from the exterior of the timepiece.

The short time depression of the switch $S_1$ causes one pulse in a differentiation circuit 41 which passes through OR gates 42, 34 to the forward direction wave shaping circuit 35 and thus becoming and additional forward rotation pulse so as to advance the timepiece by one step (30 seconds). This mode is repeated so that the hand may be advanced at will. If the similar $S_1$ is continued to be depressed for a long time, e.g., more than 2 seconds, the timepiece is advanced so much. The above differential output is delayed by 2 seconds by means of a delay circuit 43, an R-S flip-flop 44 is set so that its output Q is made "1" as a logical value and thereby an AND gate 45 is opened. Then therethrough passes the clock pulse $Cl_1$ of 64 Hz for fast-feeding the pulse motor in the forward direction so as to become a thin pulse for the forward rotation by means of the forward direction wave shaping circuit and thereby fast-feeding the timepiece. After then when the depression of the button is stopped, the switch $S_1$ is opened so that the voltage inverted in the inverter 46 resets the R-S flip-flop and as the result, the AND gate 45 is closed and the fast-feeding is terminated. After the moment when the switch $S_1$ is opened, the differentiation circuit 47 delivers its output so as to reset the delay circuit 43 and thereby the control system 40 is returned to an ordinary state. This occurs while the output from the inverter 46 is delivered to the AND gate 33 and cuts off the output from the final stage of the frequency divider 32 in operation of the switch $S_1$. This is the reason why troubles such as counting error caused by the inconvenient overlap of the divider output with fast-feeding signal are prevented. If there is effected a forward rotation fast-feeding of 22.5 seconds, the hour hand makes one rotation. The output from the circuit 48 is applied to the reverse direction wave shaping circuit 49 so that the driving wave form for the reverse rotation shown in FIGS. 4 through 6 may be obtained and thereby being applied through the OR gate 36 to the driving circuit 37 so as to rotate the pulse motor in the reverse direction. When the switch $S_2$ is depressed for a short time, the pulse motor is rotated in the reverse direction by one step and when depressed for a long time, the fast-feeding of the reverse rotation is effected. These are like the above mentioned explanations. The velocity of the fast-feeding is determined by that of the clock pulse $Cl_2$. In this embodiment, the velocity of the fast-feeding is selected at a half one with 1/256 second pulse width in case of forward rotation fast-feeding of 32 Hz. In operation of the switch $S_2$ the AND gate 33 is opened so that an ordinary feeding signal is cut off.

Figure 8A:
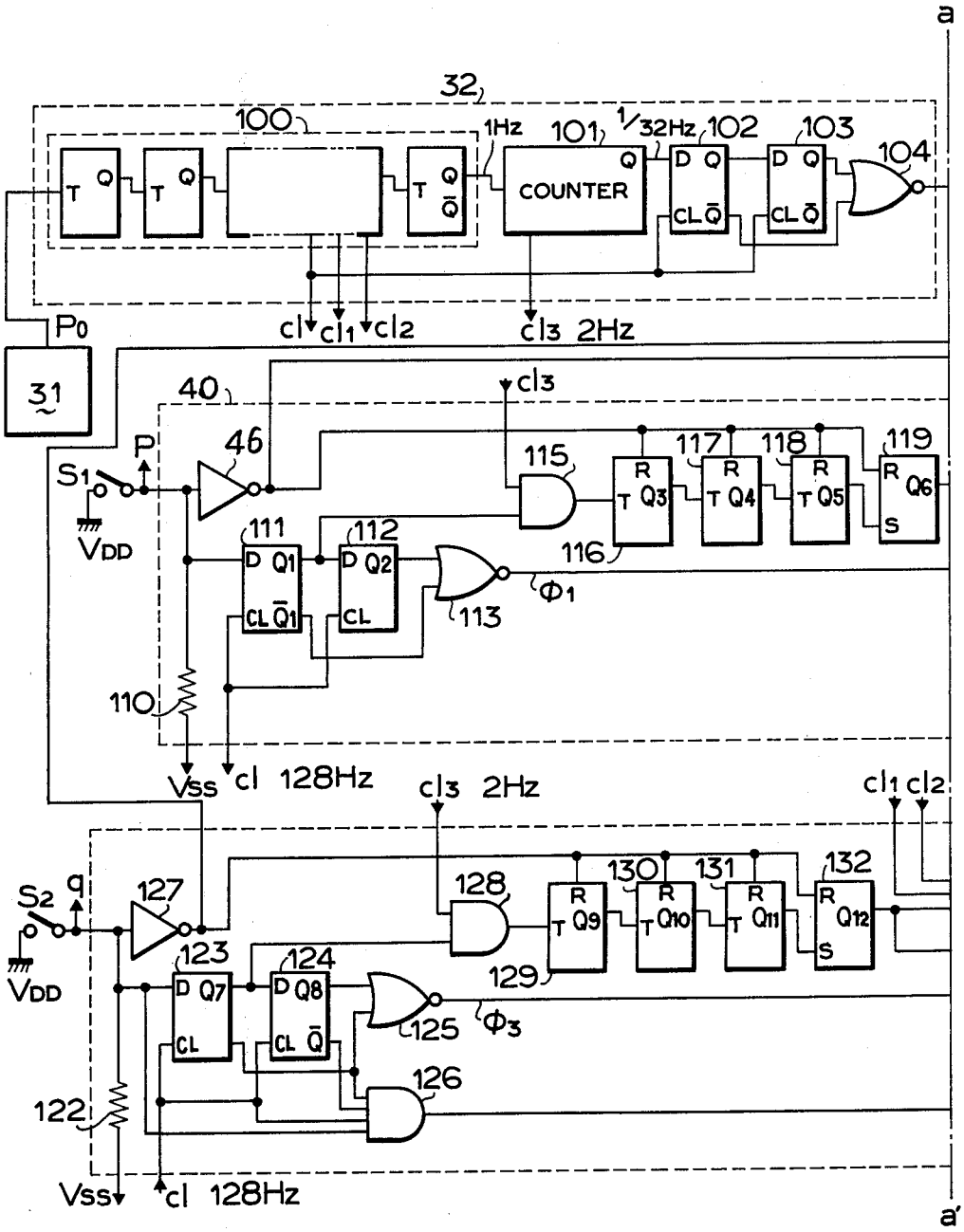
FIGS. 8*a* and 8*b* are detailed circuit diagrams of FIG. 7.
Figure 8B:
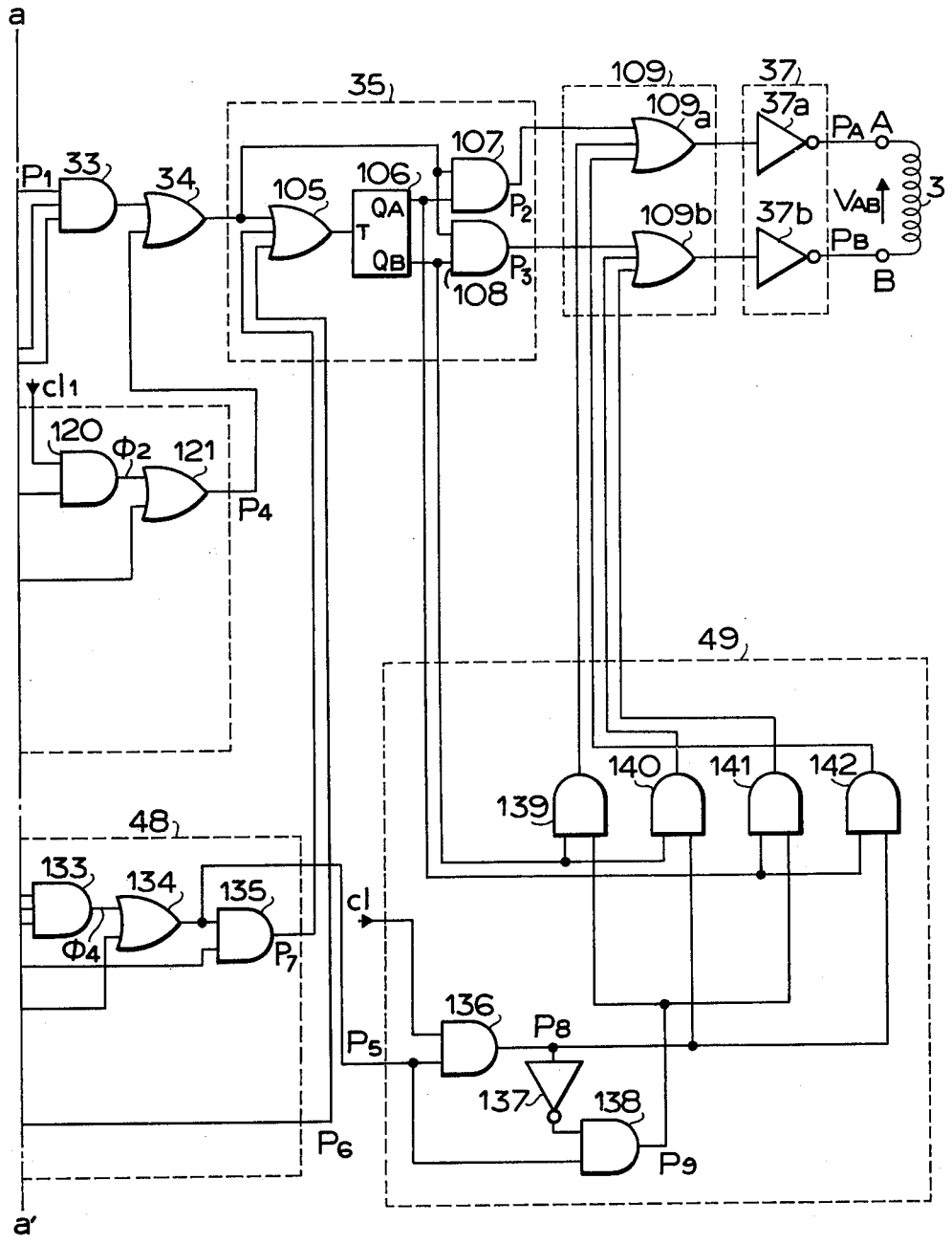

FIGS. 8*a* and 8*b* are a circuit diagram of primary parts of an electronic timepiece, of FIG. 7 is shown in greater detail. The power saving circuit 50 of FIG. 7 is deleted from FIGS. 8*a* and 8*b*. Reference numeral 31 depicts a crystal oscillator generating an output signal P*o* of 32768 Hz. 32 illustrates a divider circuit composed of a train of dividers 100 comprising toggle-type flip-flops (hereinafter abbreviated as "T-type FF") of 15 bits being connected in cascade with each other, a counter 101, of which each digit is shifted upwards every 30, receiving a 1 Hz signal of the output signal from the final stage at the train of dividers 100, a data-type flip-flop 102 (hereinafter called as D-type FF) receiving, as an input of a data terminal D, 1/31 Hz signal of the output signal from the final stage at the counter 101, a D-type FF 103 receiving the output Q from a D-type FF 102 at its data terminal D and NOR gate 104. From intermediate stages of the train of divider 100, a clock pulse $Cl$ of 128 Hz, clock pulse $Cl_1$ of 64 Hz and clock pulse $Cl_2$ of 32 Hz are derived, respectively. Further, a clock pulse $Cl_3$ of 2 Hz is derived from the intermediate stage of the counter 101. Furthermore the clock pulse $Cl$ is delivered to each clock input terminal CL of the D-type FF 102 and FF 103. NOR gate 104 receives the output $\overline{Q}$ of the D-type FF 102 and the output Q of the D-type FF 103 and delivers an output signal $P_1$ with 30 second cycle and 1/128 second pulse width.

Figure 9:
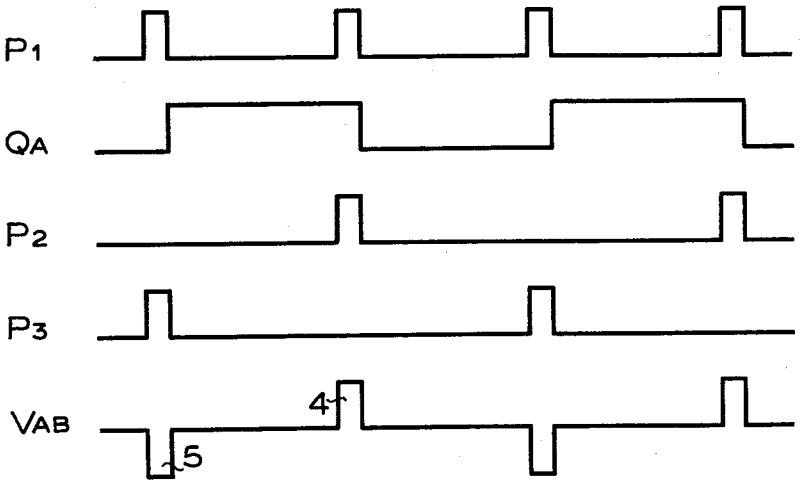
FIGS. 9 through 13 are timing charts to explain the operation of the circuit shown in FIGS. 8*a* and 8*b*.

Reference numeral 33 depicts AND gate, 34 OR gate wherein the signal $P_1$ is delivered to the forward shaping circuit 35 through the AND gate 33 and OR gate 34 when the pulse motor is rotated in the forward direction at an ordinary time. The forward shaping circuit 35 comprises OR gate 105, T-type FF 106 and AND gates 107, 108. As shown in a timing chart of FIG. 9, the signal $P_1$ is frequency-divided into outputs $Q_A$ and $Q_B$ at the T-type FF 106. Then AND gates 107, 108 synthesize signals $P_2$ and $P_3$ having 60 second cycle and 1/128 second pulse width, and being deviated by $\pi$ radian in phase from each other. These signals $P_2$ and $P_3$ are delivered through a group of OR gates 109 composed of OR gates 109*a*, 109*b* to a driving circuit 37 composed of inverters 37*a*, 37*b* so as to synthesize signals $P_A$ and $P_B$. Thus, the signals $P_A$ and $P_B$ are applied to terminals A and B across a coil 3 and thereby a pulse 4 positive in sign and pulse 5 negative in sign are obtained, of which the polarities are alternatively inverted every 30 seconds and the pulse widths are 1/128 second. The coil 3 becomes conductive by every pulse of the positive and negative pulses 4, 5 so that the pulse motor is stepped as mentioned above.

Figure 10:
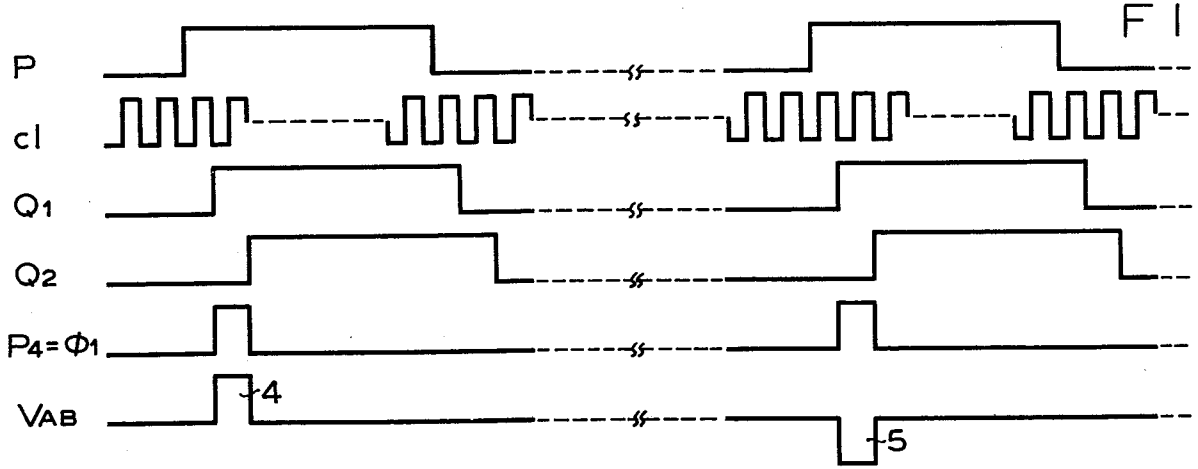
Figure 11:
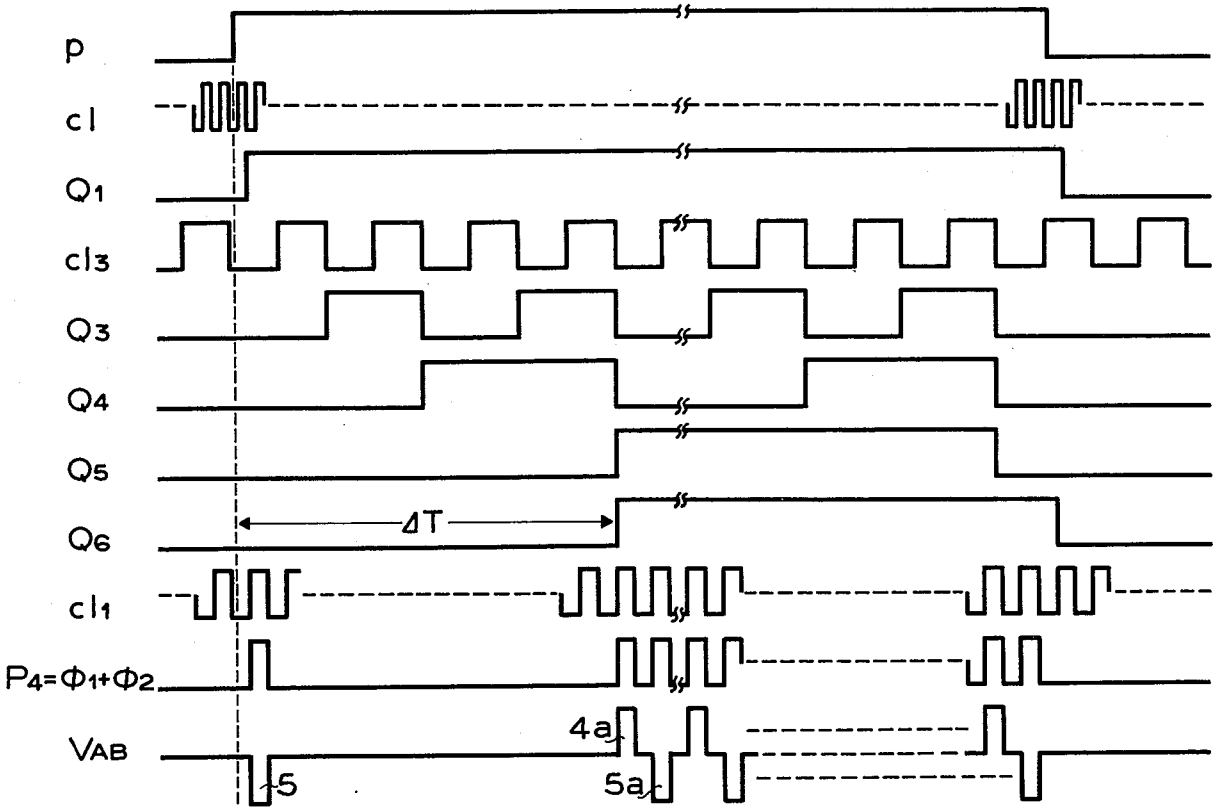

There will be described the construction and operation of a correction control circuit upon correction by the forward rotation. Reference numeral 40 denotes a correction control circuit for effecting the forward rotating correction by actuating a switch $S_1$. The correction control circuit comprises a resistor 110 to connect a contact piece terminal of a switch $S_1$ with a voltage source potential $V_{SS}$, D-type FF 111 connecting a contact piece terminal of a switch $S_1$ with the data output terminal D, D-type FF 112 receiving the output Q from the D-type FF 111 as its input, NOR gate 113 receiving the output $\overline{Q_1}$ of the D-type FF 111 and the output $Q_2$ of the D-type FF 112 as its inputs, AND gate 115 receiving the output $Q_1$ from the D-type FF 111 and the signal $Cl_3$, an inverter 114 connected to the contact piece terminal side of the switch $S_1$, T-type FF 116 receiving the output of AND gate as its input and T-type FF 117 and 118 discontinuously connected such that they may receive the output $Q_3$ from the T-type FF 116 as their inputs and thereby delivering the outputs $Q_4$ and $Q_5$ respectively, reset-set type flip-flop 119 (hereinafter called as R-S FF) receiving the output $Q_5$ of the T-type FF 118 as its set input, AND gate 120 receiving the output $Q_6$ of the R-S FF 119 and clock pulse $Cl_1$ as its inputs, and OR gate 121 receiving the output $\phi_3$ from the AND gate 120 and the output $\phi_1$ from the NOR gate 113. Each clock input terminal CL of the D-type FF 111 and 112 is connected such that a clock pulse may be supplied. The output from the inverter 114 is connected to each reset terminal R of the T-type FF 116 through 118 and R-S type FF 119. The signal $P_4$ is obtained as its output from the correction control circuit 40. As shown in the timing chart in FIG. 10, short time operation of the switch $S_1$ makes the signal P inserted into the data input terminal D of D-type FF 111 so that the output $Q_1$ synchronized with the clock pulse $Cl$ may be obtained from the output from the D-type FF 111. As the result, the output $Q_1$ is delivered to the input of the D-type FF 112 and the output $Q_2$ deviated in phase from the output $Q_1$ by one cycle of the clock pulse $Cl$. Thus, a signal $\phi_1$ with pulse width of 1/128 second corresponding to one cycle of the clock pulse $Cl$ is derived from the NOR gate 113 at the timing of $\overline{Q_1}$ = "L" and $Q_2$ = "L". Here "L" means "LOW", i.e., logical voltage level $V_{SS}$ of the battery voltage and, in reverse "H" is "HIGH", i.e., logical voltage level $V_{DD}$ as will be described later. The signal $\phi_1$ is delivered through OR gate 121 so that it may be delivered through the OR gate 34 as a signal $P_4$ equal to $\phi_1$. When $Q_A$ is equal to "H" ($Q_B$ = "L") under the condition that the output $Q_A$ from the T-type FF 106 in the forward shape circuit 35 is in a condition just prior to the operation of the switch $S_1$, a positive pulse 4 is obtained as a voltage $V_{AB}$ across the terminals A, B. Alternatively, when $Q_A$ is equal to "L" ($Q_B$ = "H") under the condition that the output $Q_A$ from the T-type FF 106 is in a condition just before the operation of the switch $S_1$, a negative pulse 5 is obtained as a voltage $V_{AB}$ across the terminals A, B. Forward rotating correction to advance the timepiece by one step (30 seconds) every one pulse is effected by means of a positive pulse 4 and negative pulse 5 having polarity alternatively changed every operation for a short time of the switch $S_1$ and pulse width of 1/128 second. The hands can be advanced at will by repeating this actuation. If the switch $S_1$ is continued to be depressed for a long time, i.e., more than about 2 seconds in this embodiment, the hands can be greatly advanced. In other words, any of the positive pulse 4 and negative pulse 5 is applied to the coil 3 as a voltage $V_{AB}$ across the terminals A, B as shown in a timing chart of FIG. 10 just after the switch $S_1$ is depressed. As the operation shown by a timing chart of FIG. 11, the clock pulse $Cl_3$ is delivered to the AND gate 115 the moment the output $Q_1$ from the D-type FF 111 becomes $Q_1$ = "H" by the clock pulse $Cl$. The clock pulse $Cl_3$ is frequency-divided by means of T-type FF 116 through 118 before the signal P becomes P = "L." The frequency division causes the T-type FF 118 to become $Q_5$ = "H" at the lapse of $\Delta T$ (about 2 seconds) after the signal P of the switch $S_1$ becomes P = "H." Then, the R-S FF 119 is set to $Q_6$ = "H" by the output $Q_5$. From the moment of $Q_6$ = "H" the signal P of the switch $S_1$ becomes P = "L" so that the clock pulse $Cl_1$ may cause the signal $P_4$ delivered through the AND gate 120 from the OR gate 121 to be $P_4 = \phi_2$ and thereby being delivered through the OR gate 34 to the forward shape circuit 35. As the result, the forward shape circuit 35, the OR gate group 109 and driving circuit 37 are operated successively so that the coil 3 is applied with the voltage across the terminals A and B, i.e., wave form signals composed of a single negative pulse 5, and continuous and repeated pulses of the positive pulse 4*a* and negative pulse 5*a* as shown in FIG. 11 in case of the output $Q_A$ = "L" just before the switch $S_1$ is depressed whereby the hands may be greatly advanced.

During the operation of the switch $S_1$, the AND gate operates so that the signal $P_1$ from the divider circuit 32 is not delivered to the forward shape circuit 35.

Next, there will be described the construction and operation of the correction control circuit when the reverse rotating correction is effected. Reference numeral 48 depicts a correction control circuit to effect the reverse rotating correction by the operation of the switch $S_2$. The correction control circuit 48 comprises a resistor 122 to connect a contact piece terminal of a switch $S_2$ to a voltage source potential $V_{SS}$, D-type FF 123 connecting the contact piece of the switch $S_2$ to the data input terminal D, D-type FF 124 receiving the output $Q_7$ from the D-type FF 123, NOR gate 125 receiving the output $Q_7$ from the D-type FF 123 and the output $Q_8$ from the D-type FF 124 so as to deliver a signal $\phi_3$, AND gate 126 receiving the signal q, clock pulse $Cl$ and outputs $\overline{Q}_7$ and $\overline{Q}_8$ so as to deliver a signal $P_6$, AND gate 128 receiving the output from $Q_7$ of the D-type FF and signal $Cl_3$, an inverter 127 connected with the contact piece of the switch $S_2$, T-type FF 129 receiving the output from the AND gate 128, T-type FF 130 and 131 being discontinuously connected such that they may receive the output $Q_9$ from the D-type FF, R-S type FF 132 receiving the output of the T-type FF as its set input, AND gate 133 receiving the output $Q_{12}$ from the R-S type FF 132 and clock pulses $Cl_1$ and $Cl_2$, OR gate 134 receiving the output $\phi_4$ from the AND gate and the output $\phi_3$ from the NOR gate 125, and AND gate 135 receiving the output $P_5$ from the OR gate 134 and the output $Q_{12}$ from the R-S FF 132 so as to deliver a signal $P_7$ as its output. Each clock input terminal CL of the D-type FF 123 and 124 is connected such that the clock pulse $Cl$ may be applied. The output from the inverter 127 is connected to each reset terminal of the FF 129 through 132.

The reverse shape circuit 49 comprises AND gate 136 receiving the output $P_5$ from OR gate 134 and clock pulse $Cl$ as its input and delivering a signal $P_8$ as its output, an inverter receiving the signal $P_8$ as its input, AND gate 138 receiving the output of the inverter 137 and the output $P_5$ of OR gate 134 as its input and delivering a signal $P_9$ as its output, AND gate 139 receiving the signal $P_9$ and the output $Q_B$ from the T-type FF 106, AND gate 140 receiving the signal $P_8$ and the output $Q_B$, AND gate 141 receiving the signal $P_9$ and the output $Q_A$ from the T-type FF, and AND gate 142 receiving the signal $P_8$ and the output $Q_A$. Both the outputs from the AND gates 139 and 142 are delivered to the respective inputs of OR gate 109*a*. Both the outputs from the AND gates 140 and 141 are delivered to the respective inputs of OR gate 109*b*.

Figure 12:
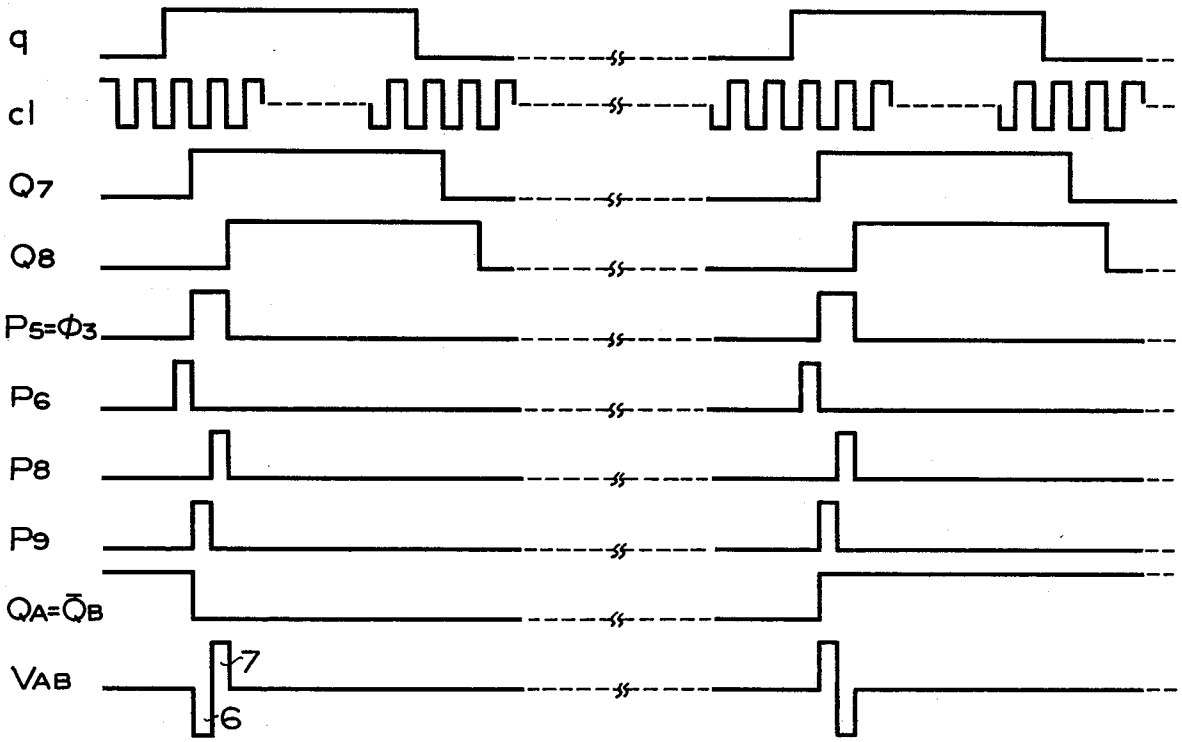

Operation for the reverse rotating correction is as shown in timing charts of FIG. 12. When the switch $S_2$ is depressed for a short time, the signal $q$ is delivered to the data input terminal CL of the D-type FF 123 so that the signal $Q_7$ synchronized with the clock pulse $Cl$ may be obtained from the output of the D-type FF 123. Then the output $Q_8$ deviated in phase from the clock pulse by one cycle is delivered by the output $Q_7$. Thus at the timing of $\overline{Q}_7$ = "L" and $Q_2$ = "L," the signal $\phi_3$ with 1/128 second pulse width corresponding to one cycle of the clock pulse $Cl$ is derived from the NOR gate 125. As the result, the signal $\phi_3$ is delivered through the OR gates 134 and 105 to the input of the T-type FF 106 as the signal $P_5$ of $P_5 = \phi_5$. While the output $P_6$ from the AND gate 126 is delivered only at the timing of $\overline{Q}_7$ = "H," $\overline{Q}_8$ = "H" and $Cl$ = "H". And then the output $P_6$ is a single pulse with 1/256 second pulse width delivered just before the signal $\phi_3$ is generated. Therefore, when the switch $S_2$ is depressed, the signal $P_6$ is generated instantly so that the output $Q_A$ from the T-type FF 106 may be inverted. For example, as shown in FIG. 12, the signal $Q_A$ may be inverted to "L" by the signal $P_6$ in case of $Q_A$ = "H" before the switch $S_2$ is depressed. The signal $P_5$ synthesized after the signal $P_6$ synthesizes, by means of AND gate 136, inverter 137 and AND gate 138 of the reverse shape circuit 49, the signals $P_8$ and $P_9$ with 1/256 second pulse width deviated in phase from each other within 1/128 second when the signal $P_5$ is "H." Thus, the signals $P_8$ and $P_9$ are imparted by the outputs $Q_A$ and $Q_B$ of the T-type 106 and AND gates 139 through 142 so that a pair of pulses composed of the negative pulse 6 and positive pulse 7 whose polarities are momentarily altered, are supplied through the OR gate group 109 and driving circuit 37 across the terminals A and B of the coil 3 as shown by $V_{AB}$ of FIG. 12 and thereby reversely rotating the rotor of the pulse motor by one step. As the result, the hands of the watch may be lost by 30 seconds every operation of the switch $S_2$.

Figure 13:
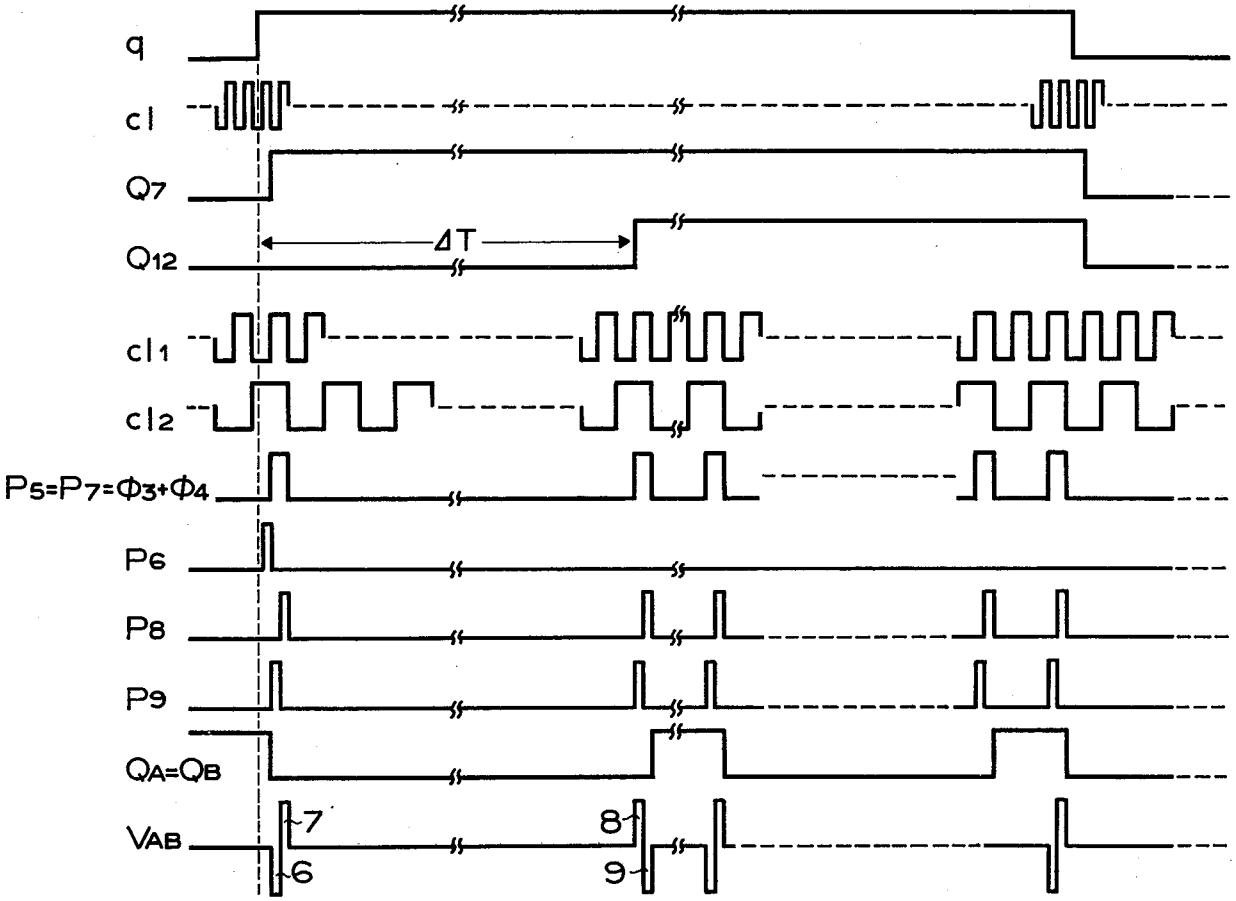

Further if the switch $S_2$ is continued to be depressed for a long time, i.e., more than 2 seconds or so in this embodiment, the hands of the timepiece can be lagged over wide range. Just after the switch $S_2$ is depressed, a pair of pulses composed of the negative pulse 6 and positive pulse 7 are applied to the coil 3 so that the rotor of the pulse motor may be reversely rotated by one step. When the switch $S_2$ is continued to be depressed further, the clock pulse $Cl_3$ is delivered to the AND gate 128 the momnet the output $Q_7$ of the D-type FF 123 becomes $Q_7$ = "H" by the clock pulse $Cl$ as shown in the timing chart of FIG. 13 so as to be frequency-divided by means of T-type FF 129 through 131 until the signal $q$ becomes $q$ = "L". In addition, the T-type FF 131 becomes $Q_{11}$ = "H" and the R-S FF 132 is reset to $Q_{12}$ = "H" at the lapse of $\Delta T$ (about 2 seconds) after the switch $S_2$ becomes $q$ = "H." As the result, only in the period from the moment of $Q_{12}$ = "H" the signal $q$ of the switch to the moment each of FF 129 through 132 is reset, the clock pulses $Cl_1$, $Cl_2$ are delivered through AND gate 133 and OR gate 134 to the reverse shape circuit 49 as $P_5 = \phi_4$. The AND gte 136, inverter 137 and AND gate 138 operates so that signals $P_8$, $P_9$ having phase deviated from each other and pulse width of 1/256 second may be synthesized within the scope of 1/128 second pulse width. Therefore, the signals $P_8$, $P_9$ are imparted by the outputs $Q_A$, $Q_B$ of the T-type FF 106 and AND gates 139 through 142. As shown by $V_{AB}$ of FIG. 13, the negative pulse 6 and positive pulse 7 are applied across the terminals A and B of the coil 3 through the OR gate group 109 and driving circuit 37 the moment the switch $S_2$ is depressed. After the lapse of about 2 seconds ($\Delta T$) a pair of the positive pulse 8 and negative pulse 9 are applied thereto. Then the operation is continued to be repeated at the interval of 1/32 second with such polarity as shown in the drawing until the switch $S_2$ is stopped to be depressed and thereby the voltage $V_{AB}$ across the terminals A and B are applied thereof. During the correction operation, the signal $P_1$ is not delivered to the forward shape circuit 35 by means of the AND gate 33. In conclusion, there can be effected correction operation for making the hands of the timepiece lose over a wide range. Reference numeral 50 depicts a power saving circuit for eliminating power consumption of the battery cell while the timepiece is not operated, e.g., process of handling it at markets. When the switches $S_1$ and $S_2$ are simultaneously closed, the output of the AND gate 51 is generated by the signals $p$ and $q$ so that the output is fixed by a latch circuit 52 and thereby keeping a transmission gate 53 open. As the result, it make the battery cell E as a power supply source turn off with respect to only the oscillation circuit 31 and circuits unnecessary for maintaining the latched state as described later. When oscillation stops, power consumption becomes almost zero especially in the C/MOS circuits since almost all circuitery conditions are latched. The hands may be carried precisely after the lapse of certain time from the moment of release of the latched condition and the frequency divider 32 is made to be reset by the output from the inverter 54 under the latched condition. When it is desired to carry the hand again the contact of one of the switches $S_1$ and $S_2$ causes the ON signal $p$ or $q$ to pass through the OR gate 55 so as to clear the latch circuit 52. Then the oscillating supply source is recovered so that the reset of the frequency divider is released to be returned to an ordinary operating condition. This system enables it to make the timepiece extremely simple in structure and small in size since complicate mechanisms for adjusting the hands are not required.

Hereinbefore, there has been described an embodiment that the reverse rotation system of this invention is adapted to hand correction and the scope of its practical application is very wide since there can be obtained very new indicating effects. For example, illustrated may be an effect of alarming the fact that the time to exchange a battery has approached by detecting exhaustion of the energy stored therein by means of a suitable sensor to advance the second hand by two steps and return it by one step every second, advancing it by three steps every even seconds or returning it by one step every odd second or seconds. Further, the invention provides many effects that a set difference in time in a world watch is automatically corrected and that there are provided a timepiece used in turnover manner and one with hands reversely rotated. Therefore, the pulse motor driving system of this invention is extremely valuable in practice. Furthermore, if suitable wave forms are selected, this invention may be applied to the other type pulse motors, e.g., one whose rotor is multipolar or magnetized in the axial direction, or is turned round by one step, etc.

What is claimed is:

1. A pulse motor driving system for use in a timepiece comprising:

a. a pulse motor having a stator, a driving coil wound on said stator and a permanent magnet rotor coupled to said stator;

b. a forward correction control circuit including a forward rotation wave shaping circuit generating a pulse train having pulses of alternating polarity;

c. a reverse correction control circuit including a reverse rotation wave shaping circuit generating a reverse rotation composite pulse train having composite pulses of alternating polarity; and d. selection circuit means selectively applying an output of said forward correction control circuit and an output of said reverse correction control circuit to said pulse motor driving circuit.

2. The pulse motor driving system as claimed in claim 1 wherein the width of the individual pulses constituting said reverse rotation composite pulses is narrower than the width of the individual pulses constituting said forward rotation pulses.

3. The pulse motor driving system as claimed in claim 1 wherein said forward rotation wave shaping circuit is included with an ordinary driving system of said timepiece and said reverse rotation wave shaping circuit is included with a time correction system of said timepiece.

4. The pulse motor driving system as claimed in claim 3 wherein said selection circuit means is provided with a control switch which controls a latch circuit which selectively connects and disconnects an oscillation circuit of said timepiece.

5. The pulse motor driving system as claimed in claim 4 wherein said stator is non-symmetrical causing said rotor to have a static stable position which forms an angle with the direction of polarity of said stator.

6. The pulse motor driving system as claimed in claim 1 wherein said composite pulses for driving said rotor in the reverse direction comprise a first narrow pulse having a polarity opposite a first pulse of the forward driving pulses and a second pulse successive to said first pulse which has a polarity opposite the first narrow pulse.

7. The pulse motor driving system as claimed in claim 6 wherein the width of said first pulse is half the first pulse of the forward driving pulses and the second pulse starts when the first pulse ends.

8. The pulse motor driving system as claimed in claim 4 wherein a frequency divider is connected between said oscillator circuit and said forward and reverse correction control circuits.

9. The pulse motor driving system as claimed in claim 5 wherein said stator has first and second semi-circular portions having a radius of 1.1 millimeters, said portions having a relative deviation of 40 micrometers.

10. The pulse motor driving system as claimed in claim 1 wherein a fast forward pulse shaping circuit is connected between an oscillator and said forward rotation wave shaping circuit and a fast reverse pulse shaping circuit is connected between the oscillator and said reverse rotation wave shaping circuit.

* * * * *

UNITED STATES PATENT AND TRADEMARK OFFICE

CERTIFICATE OF CORRECTION

PATENT NO. : 4,112,671

DATED : September 12, 1978

INVENTOR(S) : Kato, et al

It is certified that error appears in the above-identified patent and that said Letters Patent are hereby corrected as shown below:

In claim 1, column 10, line 12, after "stator" insert -- and a pulse motor driving circuit coupled to said pulse motor --

Signed and Sealed this

*Twenty-fifth* Day of *March 1980*

[SEAL]

*Attest:*

SIDNEY A. DIAMOND

*Attesting Officer*

*Commissioner of Patents and Trademarks*